US010441084B2

(12) United States Patent
Chung

(10) Patent No.: US 10,441,084 B2
(45) **Date of Patent: *Oct. 15, 2019**

(54) LIGHTWEIGHT MODULAR BED

(71) Applicant: ULIFE HEALTHCARE INC., Taoyuan (TW)

(72) Inventor: Ya-Hsin Chung, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/108,433

(22) Filed: Aug. 22, 2018

(65) Prior Publication Data

US 2019/0008281 A1 Jan. 10, 2019

Related U.S. Application Data

(63) Continuation-in-part of application No. 15/806,906, filed on Nov. 8, 2017.

(30) Foreign Application Priority Data

Feb. 18, 2017 (TW) ..... 106202395 U
Apr. 2, 2018 (TW) ..... 107204320 U

(51) Int. Cl.
*A47C 19/02* (2006.01)
*A47C 19/04* (2006.01)
*A47C 21/06* (2006.01)

(52) U.S. Cl.
CPC ..... *A47C 19/025* (2013.01); *A47C 19/04* (2013.01); *A47C 19/045* (2013.01); *A47C 21/06* (2013.01)

(58) Field of Classification Search
CPC ..... A47C 19/025; A47C 19/005; A47C 19/12; A47C 19/04; A47C 19/045; A47C 19/126; A47C 19/124; A47C 20/12; A47C 20/041; A47C 20/08; A47C 21/02; A47C 21/022; A47C 21/06; A47C 29/00; A47C 29/003; A47C 29/006
See application file for complete search history.

(56) References Cited

U.S. PATENT DOCUMENTS 3,854,152 A * 12/1974 Chez ..... A61G 7/1019 5/81.1 C
3,994,033 A * 11/1976 Bendell ..... A47C 23/20 5/202
4,012,800 A * 3/1977 Mitchell ..... A23B 7/148 5/187
4,239,281 A * 12/1980 Luca' ..... A47C 17/213 297/108
4,479,993 A * 10/1984 James ..... A61G 7/001 428/192

(Continued)

*Primary Examiner* — Robert G Santos
*Assistant Examiner* — Rahib T Zaman
(74) *Attorney, Agent, or Firm* — Allen, Dyer, Doppelt + Gilchrist, PA

(57) ABSTRACT

A lightweight modular bed includes a bed frame unit, a first retaining unit, a second retaining unit, a supporting web unit, and at least one reinforcement insert. The supporting web unit can be fully stretched on the bed frame unit by virtue of the first and second retaining units, and has a plurality of through bores. The reinforcement insert is configured to be detachably inserted in each of the through bores for adjusting flexibility of the supporting web unit.

5 Claims, 5 Drawing Sheets

(56) References Cited

U.S. PATENT DOCUMENTS

| | | | | | |
|---|---|---|---|---|---|
| 4,771,489 | A * | 9/1988 | Chen | A61G 5/006 | 4/585 |
| 4,825,484 | A * | 5/1989 | Riegel | A47C 29/003 | 135/132 |
| 5,494,066 | A * | 2/1996 | McMahan | A47C 29/006 | 135/116 |
| 5,860,175 | A * | 1/1999 | Saiki | A45F 3/26 | 5/111 |
| 6,151,730 | A * | 11/2000 | Weston | A47C 19/122 | 5/110 |
| 6,588,037 | B1 * | 7/2003 | Eno | A47C 29/006 | 135/90 |
| 6,687,930 | B1 * | 2/2004 | Eads | A47C 29/003 | 135/121 |
| 6,694,547 | B1 * | 2/2004 | Vail | A47C 29/003 | 5/414 |
| 7,246,389 | B2 * | 7/2007 | Taguchi | A61G 7/001 | 5/608 |
| 10,154,931 | B1 * | 12/2018 | Vann | A61G 7/015 | |
| 2001/0054198 | A1 * | 12/2001 | Choi | A47C 4/286 | 5/114 |
| 2005/0045221 | A1 * | 3/2005 | Forshpan | A47C 29/003 | 135/135 |
| 2006/0085913 | A1 * | 4/2006 | Kawakami | A47C 19/045 | 5/618 |
| 2009/0119837 | A1 * | 5/2009 | Benezra | A47D 5/00 | 5/424 |
| 2016/0270992 | A1 * | 9/2016 | Wang | A61G 7/015 | |
| 2017/0209321 | A1 * | 7/2017 | Shih | A61G 7/018 | |
| 2018/0235373 | A1 * | 8/2018 | Tsai | A47C 20/041 | |
| 2018/0318158 | A1 * | 11/2018 | Tsai | A61G 7/015 | |

* cited by examiner

LIGHTWEIGHT MODULAR BED

CROSS-REFERENCE TO RELATED APPLICATION

This application claims priority from Taiwanese utility model patent application no. 107204320, filed on Apr. 2, 2018, and is a continuation-in-part (CIP) of co-pending U.S. patent application Ser. No. 15/806,906, filed on Nov. 8, 2017. Co-pending U.S. patent application Ser. No. 15/806,906 and Ser. No. 15/990,104, are incorporated herein by reference.

FIELD

The disclosure relates to a lightweight modular bed, more particularly to a lightweight modular bed with adjustable flexibility.

BACKGROUND

A conventional bed frame, such as an electric bed frame disclosed in U.S. patent application publication no. 2017/0209321 A1, includes a fixed rack, a movable rack, a thigh rack, a shank rack, an actuator, four supporting boards, and a bracket. The conventional bed frame including the supporting boards is heavy and inconvenient for transportation.

SUMMARY

Therefore, an object of the disclosure is to provide a lightweight modular bed.

According to a first aspect of the disclosure, a lightweight modular bed includes a bed frame unit, a first retaining unit, a second retaining unit, a supporting web unit, and at least one reinforcement insert. The bed frame unit includes a front leading beam and a rear trailing beam which are opposite to each other in a longitudinal direction. Each of the front leading beam and the rear trailing beam extends in a transverse direction relative to the longitudinal direction to terminate at a first end segment and a second end segment. The first retaining unit has a first front segment and a first rear segment, which are opposite to each other, and which are coupled to the first end segments of the front leading beam and the rear trailing beam, respectively. The second retaining unit has a second front segment and a second rear segment, which are opposite to each other, and which are coupled to the second end segments of the front leading beam and the rear trailing beam, respectively. The supporting web unit is configured to be fully stretched on the bed frame unit in a stretching position, and includes a web body and two lateral portions. The web body extends along a central line, and has a plurality of left through bores and a plurality of right through bores. The left through bores are formed in the web body at a left side of the central line, and are displaced from each other along a left lengthwise line parallel to the central line. The right through bores are formed in the web body at a right side of the central line, and are displaced from each other along a right lengthwise line parallel to the central line. The two lateral portions are at opposite sides of the web body, and are coupled to the first and second retaining units, respectively, so as to permit the web body to be fully stretched between the first and second retaining units. The reinforcement insert is configured to be detachably inserted in each of the left and right through bores for adjusting flexibility of the web body, and includes an inserted region and an enlarged region. The inserted region has a dimension slightly larger than that of each of the left and right through bores. The enlarged region is opposite to the inserted region, and is configured such that when the inserted region is fittingly inserted into one of the left and right through bores, the enlarged region is retained on the web body.

According to a second aspect of the disclosure, a lightweight modular bed includes a base frame unit, a bed frame unit, a drive unit, a supporting web unit, and at least one reinforcement insert. The bed frame unit includes a plurality of support frames which are mounted on the base frame unit to be displaced from each other in a longitudinal direction. Each of the support frames has a leading bar and a trailing bar which is displaced from the leading bar in the longitudinal direction. Each of the leading and trailing bars extends in a transverse direction relative to the longitudinal direction to terminate at a first end segment and a second end segment. At least one of the support frames is turnably mounted to the base frame unit to permit one of the leading and trailing bars of the at least one of the support frames to be displaced between a normal position, where the one of the leading and trailing bars of the at least one of the support frames is close to the ground, and an elevated position, where the one of the leading and trailing bars of the at least one of the support frames is remote from the ground. The drive unit is coupled between the base frame unit and the at least one of the support frames to drive movement of the at least one of the support frames. The supporting web unit is configured to be fully stretched on the bed frame unit in a stretching position, and has a plurality of through bores. The reinforcement insert is configured to be detachably inserted in each of the through bores for adjusting flexibility of the supporting web unit.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
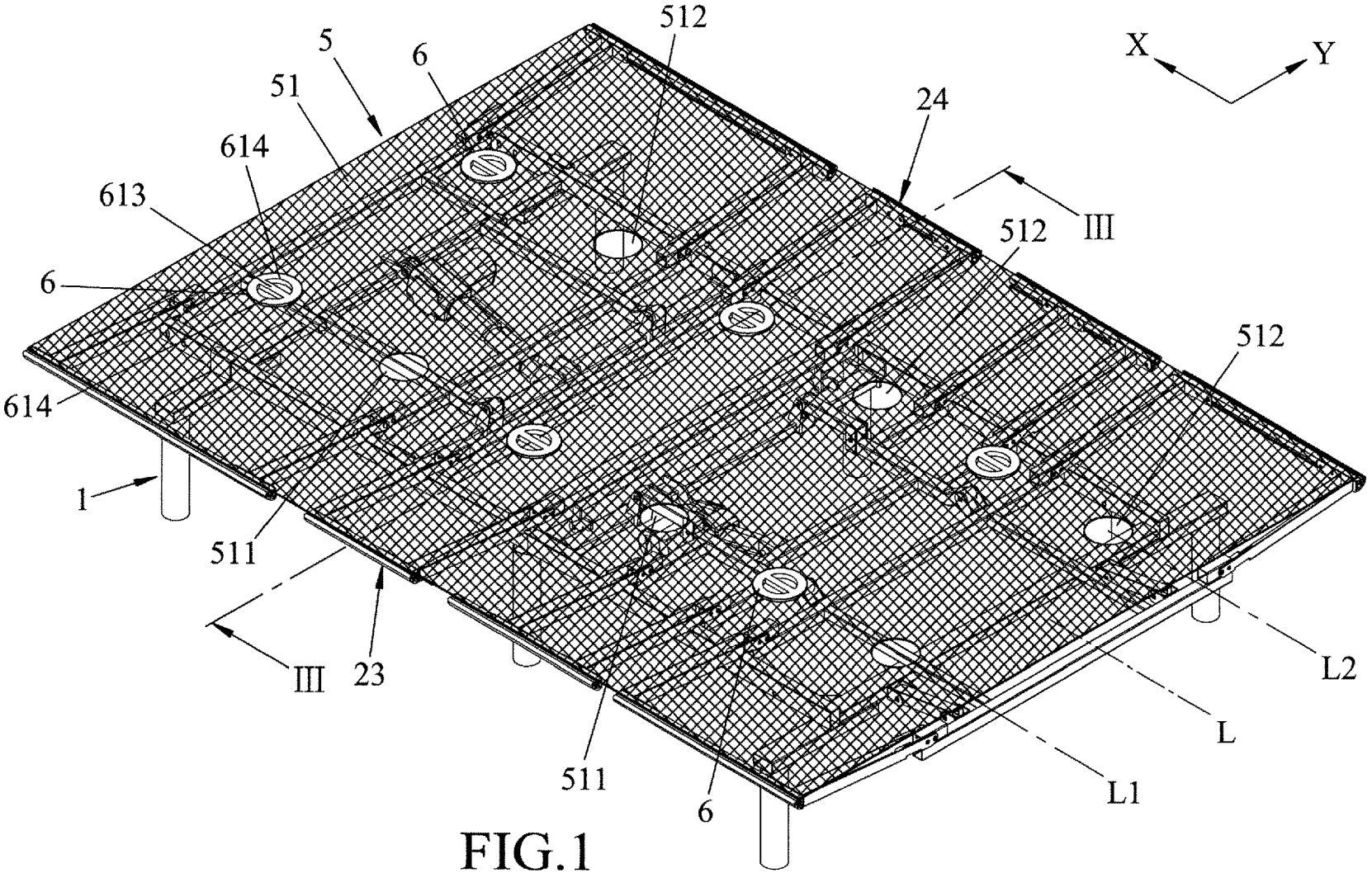
FIG. 1 is a perspective view of a lightweight modular bed according to an embodiment of the disclosure.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 2:
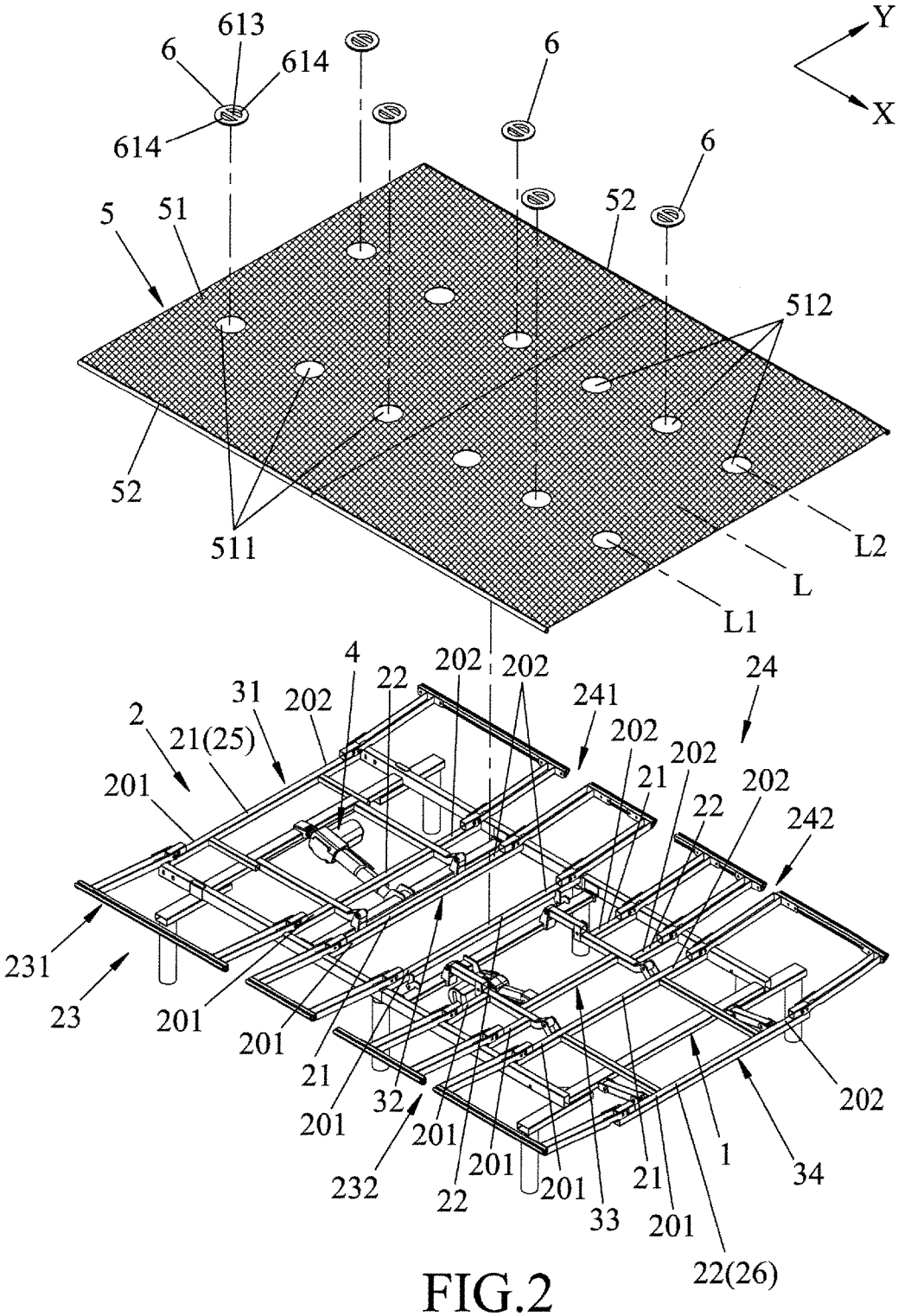
FIG. 2 is an exploded perspective view of the lightweight modular bed.

Referring to FIGS. 1 and 2, a lightweight modular bed for supporting a mattress (not shown) according to an embodiment of the disclosure is shown to include a bed frame unit 2, a first retaining unit 23, a second retaining unit 24, a supporting web unit 5, and at least one reinforcement insert 6.

The bed frame unit 2 includes a front leading beam 25 and a rear trailing beam 26 which are opposite to each other in a longitudinal direction (X). Each of the front leading beam 25 and the rear trailing beam 26 extends in a transverse direction (Y) relative to the longitudinal direction (X) to terminate at a first end segment 201 and a second end segment 202.

The first retaining unit 23 has a first front segment 231 and a first rear segment 232, which are opposite to each other, and which are coupled to the first end segments 201 of the front leading beam 25 and the rear trailing beam 26, respectively.

The second retaining unit 24 has a second front segment 241 and a second rear segment 242, which are opposite to each other, and which are coupled to the second end segments 202 of the front leading beam 25 and the rear trailing beam 26, respectively.

Figure 3:
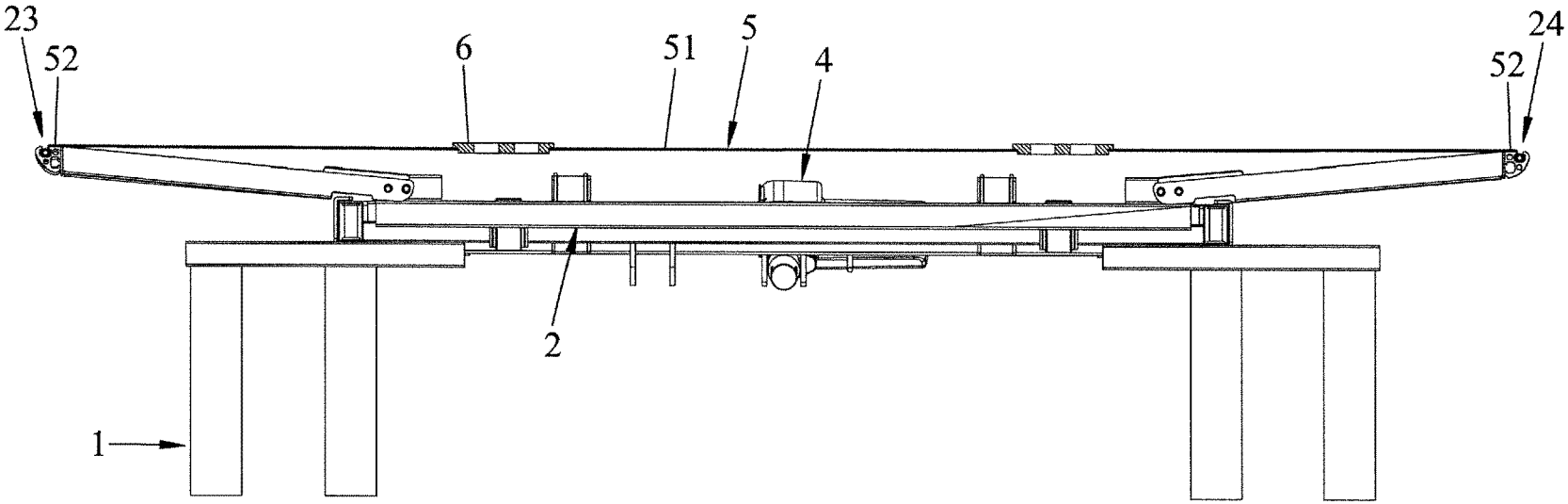
FIG. 3 is a partial sectional view taken along line of FIG. 1.

The supporting web unit 5 is configured to be fully stretched on the bed frame unit 2 in a stretching position, and includes a web body 51 and two lateral portions 52. The web body 51 extends along a central line (L). The two lateral portions 52 are at opposite sides of the web body 51, and are coupled to the first and second retaining units 23, 24, respectively, so as to permit the web body 51 to be fully stretched between the first and second retaining units 23, 24 (FIG. 3). The web body 51 and two lateral portions 52 are similar to those disclosed in co-pending U.S. patent application Ser. No. 15/806,906 and Ser. No. 15/990,104, except that the web body 51 of this disclosure has at least one left through bore 511 and at least one right through bore 512.

In an embodiment shown in FIGS. 1 and 2, the web body 51 has a plurality of the left through bores 511 and a plurality of the right through bores 512. The left through bores 511 are formed in the web body 51 at a left side of the central line (L), and are displaced from each other along a left lengthwise line (L1) parallel to the central line (L). The right through bores 512 are formed in the web body 51 at a right side of the central line (L), and are displaced from each other along a right lengthwise line (L2) parallel to the central line (L).

The reinforcement insert 6 is configured to be detachably inserted in each of the left and right through bores 511, 512 for adjusting flexibility of the web body 51, and includes an inserted region 611 and an enlarged region 612. The inserted region 611 has a dimension slightly larger than that of each of the left and right through bores 511, 512. The enlarged region 612 is opposite to the inserted region 611, and is configured such that when the inserted region 611 is fittingly inserted into one of the left and right through bores 511, 512, the enlarged region 612 is retained on the web body 51.

The reinforcement insert 6 has a larger hardness than the web body 51, and may be made from a rigid material.

Figure 4:
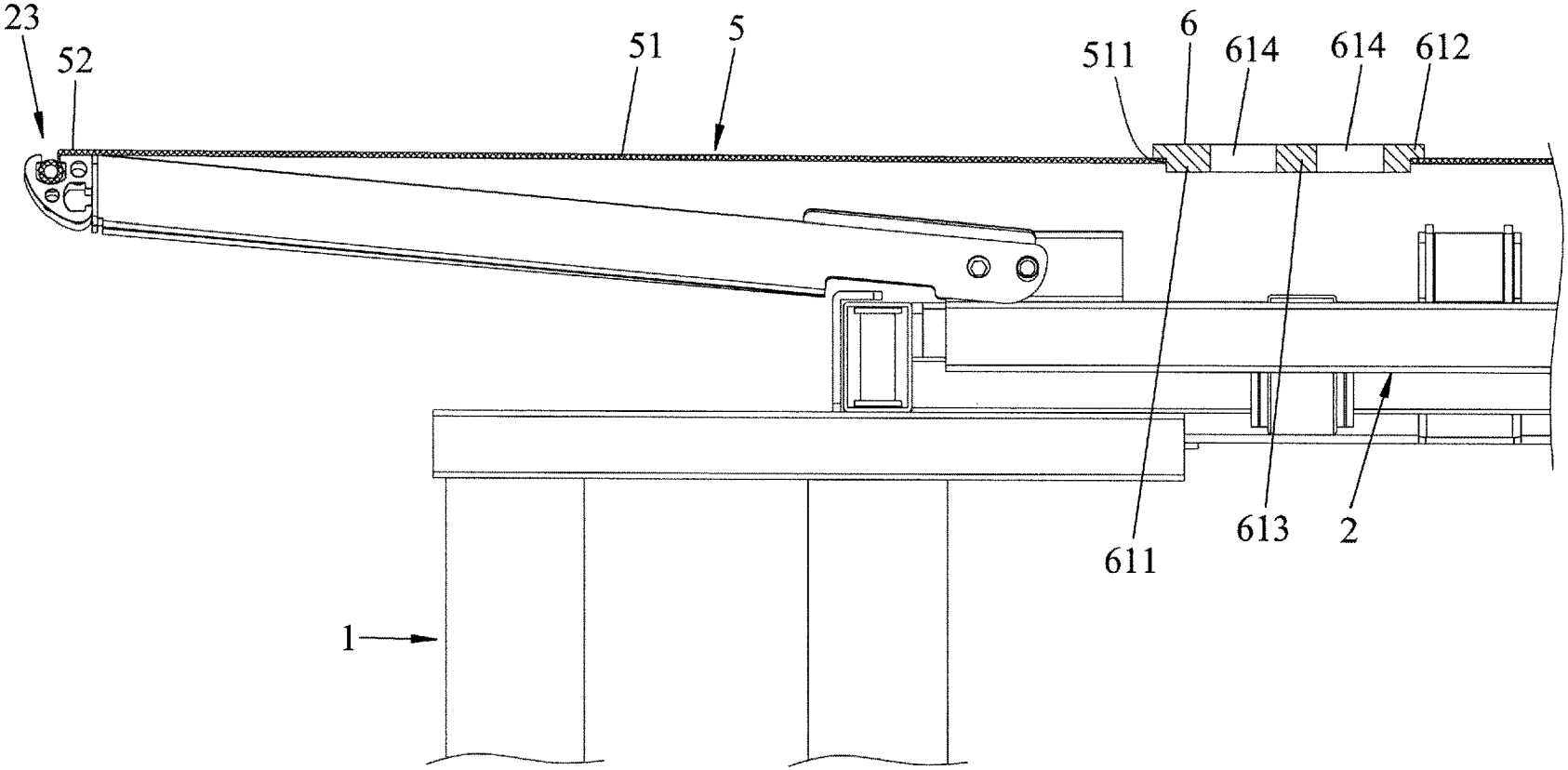
FIG. 4 is a fragmentary enlarged view of FIG. 3.

In an embodiment shown in FIGS. 2 and 4, the reinforcement insert 6 has two slots 614 which are spaced apart from each other. Each of the slots 614 extends through the inserted region 611 and the enlarged region 612 to form a hand-grip 613 between the slots 614.

Figure 5:
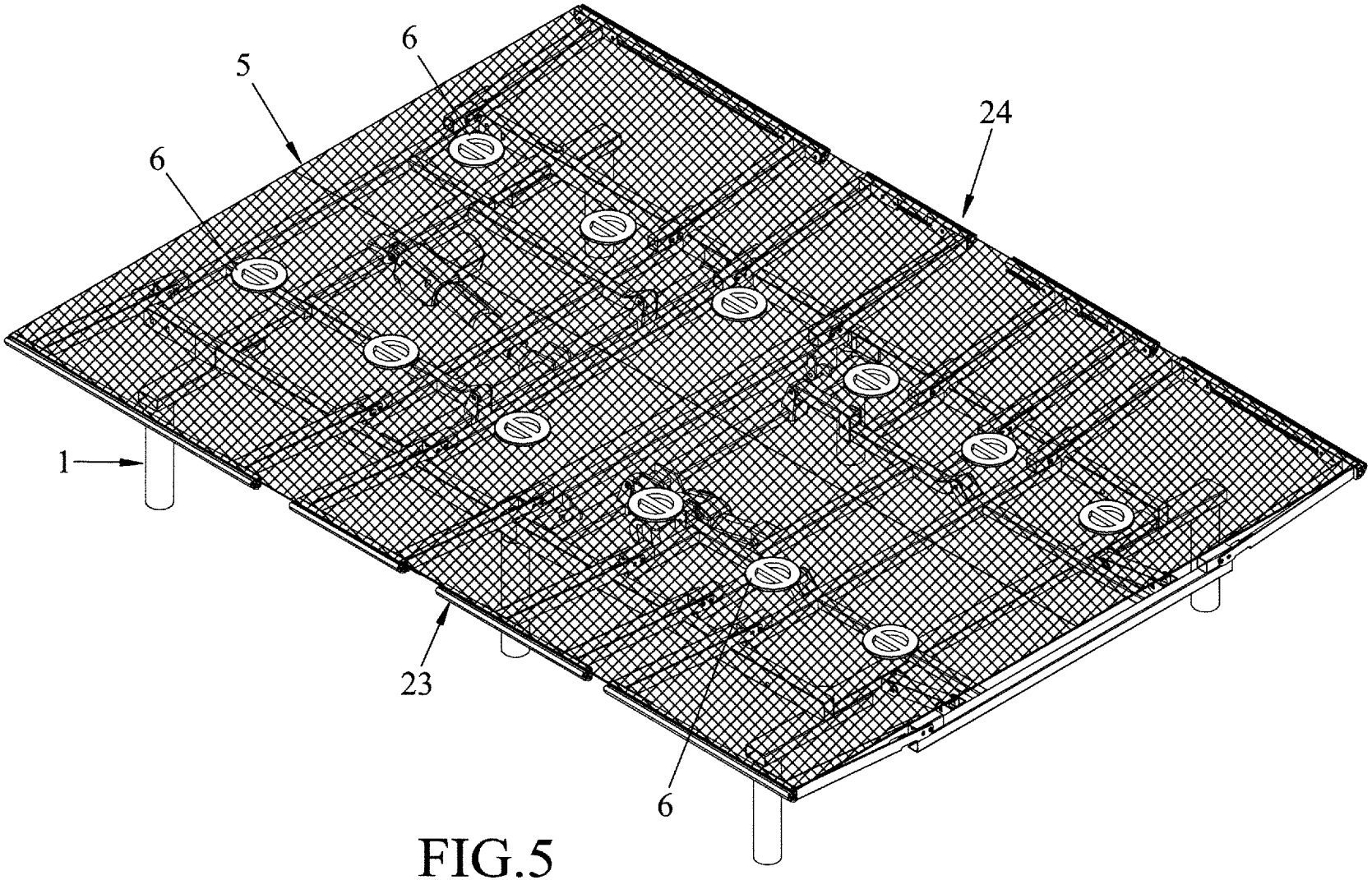
FIG. 5 is similar to FIG. 1 but illustrating that a plurality of reinforcement inserts are respectively inserted in all of through bores of a supporting web unit of the lightweight modular bed.

For adjusting the flexibility of the web body 51, a user may insert a required numbers of the reinforcement inserts 6 in the desired through holes 511, 512 as need. In an embodiment shown in FIGS. 1 and 2, one half of the through bores 511, 512 are respectively inserted with the reinforcement inserts 6. In an embodiment shown in FIG. 5, all the through bores 511, 512 are respectively inserted with the reinforcement inserts 6.

In an embodiment shown in FIG. 2, the lightweight modular bed further includes abase frame unit 1 on which the bed frame unit 2 is mounted, and the bed frame unit 2 includes a plurality of support frames 31, 32, 33, 34 which are displaced from each other in the longitudinal direction (X).

Each of the support frames 31, 32, 33, 34 has a leading bar 21 and a trailing bar 22 which is displaced from the leading bar 21 in the longitudinal direction (X). Each of the leading and trailing bars 21, 22 extends in the transverse direction (Y) to terminate at a first end segment 201 and a second end segment 202.

Furthermore, the leading bar 21 of a leading one of the support frames 31, 32, 33, 34 serves as the front leading beam 25, and the trailing bar 22 of a trailing one of the support frames 31, 32, 33, 34 serves as the rear trailing beam 26.

In addition, at least one of the support frames 31, 32, 33, 34 is turnably mounted to the base frame unit 1 to permit one of the leading and trailing bars 21, 22 of the at least one of the support frames 31, 32, 33, 34 to be displaced between a normal position (FIG. 1), where the one of the leading and trailing bars 21, 22 of the at least one of the support frames 31, 32, 33, 34 is close to the ground, and an elevated position (not shown), where the one of the leading and trailing bars 21, 22 of the at least one of the support frames 31, 32, 33, 34 is remote from the ground.

In an embodiment shown in FIG. 2, the lightweight modular bed may further include a drive unit 4 which is coupled between the base frame unit 1 and the at least one of the support frames 31, 32, 33, 34 to drive movement of the at least one of the support frames 31, 32, 33, 34.

The details for the base frame unit 1, the support frames 31, 32, 33, 34, the first and second retaining units 23, 24, and the drive unit 4 may be reference to co-pending U.S. patent application Ser. No. 15/806,906 and Ser. No. 15/990,104, and are omitted for clarity.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A lightweight modular bed comprising:

a bed frame unit including a front leading beam and a rear trailing beam which are opposite to each other in a longitudinal direction, each of said front leading beam and said rear trailing beam extending in a transverse direction relative to said longitudinal direction to terminate at a first end segment and a second end segment;

a first retaining unit having a first front segment and a first rear segment, which are opposite to each other, and which are coupled to said first end segments of said front leading beam and said rear trailing beam, respectively;

a second retaining unit having a second front segment and a second rear segment, which are opposite to each other, and which are coupled to said second end segments of said front leading beam and said rear trailing beam, respectively;

a supporting web unit configured to be fully stretched on said bed frame unit in a stretching position, and including a web body extending along a central line, and having at least one left through bore which is formed in said web body at a left side of said central line, and at least one right through bore which is formed in said web body at a right side of said central line, and two lateral portions which are at opposite sides of said web body, and which are coupled to said first and second retaining units, respectively, so as to permit said web body to be fully stretched between said first and second retaining units; and at least one reinforcement insert which is configured to be detachably inserted in each of said left and right through bores for adjusting flexibility of said web body, and which includes an inserted region having a dimension slightly larger than that of each of said left and right through bores, and an enlarged region which is opposite to said inserted region, and which is configured such that when said inserted region is fittingly inserted into one of said left and right through bores, said enlarged region is retained on said web body, wherein said reinforcement insert has two slots which are spaced apart from each other, each of said slots extending through said inserted region and said enlarged region to form a hand-grip between said slots.

2. The lightweight modular bed according to claim 1, wherein said web body has a plurality of said left through bores which are displaced from each other along a left lengthwise line parallel to said central line, and a plurality of said right through bores which are displaced from each other along a right lengthwise line parallel to said central line.

3. The lightweight modular bed according to claim 1, further comprising a base frame unit on which said bed frame unit is mounted, wherein said bed frame unit includes a plurality of support frames which are displaced from each other in said longitudinal direction, each of said support frames having a leading bar and a trailing bar which is displaced from said leading bar said the longitudinal direction, each of said leading and trailing bars extends in the transverse direction to terminate at a first end segment and a second end segment, said leading bar of a leading one of said support frames serves as said front leading beam, and said trailing bar of a trailing one of said support frames serves as said rear trailing beam, and at least one of said support frames is turnably mounted to said base frame unit to permit one of said leading and trailing bars of said at least one of said support frames to be displaced between a normal position, where said one of said leading and trailing bars of said at least one of said support frames is close to the ground, and an elevated position, where said one of said leading and trailing bars of said at least one of said support frames is remote from the ground.

4. The lightweight modular bed according to claim 3, further comprising a drive unit which is coupled between said base frame unit and said at least one of said support frames to drive movement of said at least one of said support frames.

5. A lightweight modular bed comprising:

a base frame unit;

a bed frame unit including a plurality of support frames which are mounted on said base frame unit to be displaced from each other in a longitudinal direction, each of said support frames having a leading bar and a trailing bar which is displaced from said leading bar in said longitudinal direction, each of said leading and trailing bars extending in a transverse direction relative to said longitudinal direction to terminate at a first end segment and a second end segment, at least one of said support frames being turnably mounted to said base frame unit to permit one of said leading and trailing bars of said at least one of said support frames to be displaced between a normal position, where said one of said leading and trailing bars of said at least one of said support frames is close to the ground, and an elevated position, where said one of said leading and trailing bars of said at least one of said support frames is remote from the ground;

a drive unit which is coupled between said base frame unit and said at least one of said support frames to drive movement of said at least one of said support frames;

a supporting web unit which is configured to be fully stretched on said bed frame unit in a stretching position, and which has a plurality of through bores; and at least one reinforcement insert which is configured to be detachably inserted in each of said through bores for adjusting flexibility of said supporting web unit, and which includes an inserted region having a dimension slightly larger than that of each of said through bores, and an enlarged region which is opposite to said inserted region, and which is configured such that when said inserted region is fittingly inserted into one of said through bores, said enlarged region is retained on said web body, wherein said reinforcement insert has two slots which are spaced apart from each other, each of said slots extending through said inserted region and said enlarged region to form a hand-grip between said slots.

* * * * *